US006240695B1

(12) United States Patent
Karalic et al.

(10) Patent No.: US 6,240,695 B1
(45) Date of Patent: Jun. 5, 2001

(54) FRAME WALL REINFORCEMENT

(76) Inventors: Meho Karalic, #23-5760 East Hastings Street, Burnaby, British Columbia (CA), V5B 1R6; Arthur J. Paul, 23077 Fraser Highway, Langley, British Columbia (CA), V3A 4P6

( * ) Notice: Subject to any disclaimer, the term of this patent is extended or adjusted under 35 U.S.C. 154(b) by 0 days.

(21) Appl. No.: 08/955,805

(22) Filed: Oct. 22, 1997

Related U.S. Application Data

(63) Continuation-in-part of application No. 08/278,004, filed on Jul. 20, 1994, now abandoned.

(51) Int. Cl.[7] ..... E04H 12/00

(52) U.S. Cl. ..... 52/690; 52/656.9; 52/656.1; 52/693; 52/695; 52/657

(58) Field of Search ..... 52/690, 693, 695, 52/694, 657, 656.1, 264, 265, 262, 236.3, 234, 236.1, 270, 745.2, 745.13, 745.1, 656.9; 144/353; 29/897.312

(56) References Cited

U.S. PATENT DOCUMENTS

| | | | | |
|---|---|---|---|---|
| 1,849,273 | * | 3/1932 | Broderick | 52/657 |
| 2,073,889 | * | 3/1937 | Trout | 52/656.1 |
| 2,191,804 | * | 2/1940 | O'Malley | 52/693 |
| 2,538,138 | * | 1/1951 | Webster | 52/657 |
| 3,516,215 | * | 6/1970 | Smith et al. | 52/656.9 |
| 4,156,995 | * | 6/1979 | Zusman | 52/693 |
| 4,283,900 | * | 8/1981 | Schubert | 52/656.9 |
| 4,955,521 | * | 9/1990 | Michael | 227/3 |
| 5,505,031 | * | 4/1996 | Heydon | 52/270 |
| 5,904,025 | * | 5/1999 | Bass et al. | 52/741.3 |

FOREIGN PATENT DOCUMENTS

| | | | | |
|---|---|---|---|---|
| 162326 | * | 2/1949 | (AU) | 52/657 |
| 259837 | * | 5/1913 | (DE) | 52/657 |

* cited by examiner

*Primary Examiner*—Carl D. Friedman
*Assistant Examiner*—Dennis L. Dorsey

(57) ABSTRACT

A pre-manufactured reinforcement structure comprising elongate side, top and bottom members connected by metal comer connectors into a rectangular frame and elongate brace members extending between the side members and forming, with the side members, adjacent triangular structures along the entire lengths of the side members.

5 Claims, 9 Drawing Sheets

FRAME WALL REINFORCEMENT

CROSS-REFERENCE TO RELATED APPLICATION

This is a continuation-in-part of Ser. No. 08/278,004, filed Jul. 20, 1994, now abandoned.

BACKGROUND OF THE INVENTION

1. Field of the Invention

The present invention relates to methods of reinforcing frame walls of building structures against horizontal loads, and includes frame wall reinforcement structures and methods of manufacturing such structures.

2. Description of the Related Art

Conventional frame wall construction in building structures employs vertical studs extending between a sole plate and a top plate, usually with a sheathing panel nailed to the studs to provide some reinforcement against horizontal loads exerted on the frame walls.

It is also well known to further reinforce such frame walls against horizontal loads by means of diagonal bracing extending across and inset into the outer faces of the studs, by angled bracing installed between successive pairs of studs or by diagonal or other sheathing on one or both sides of each wall.

Such conventional methods of reinforcing frame wall construction against horizontal loads are now becoming to be considered as insufficient. For example, observations of results of earthquakes have, in recent times, shown that there is a substantial need to further reinforce frame wall constructions against horizontal earthquake loads.

Such additional reinforcement is desirable, in particular, in the first-storey walls of buildings, which are weakened by the provision of doorways and, also, by the provision of windows which, in general, tend to be larger than those of the remaining storeys of the building, and in addition by the weight of the overlying building structure.

Furthermore, the above-described conventional bracing methods rely on the availability and level of carpentry skills of construction workers. Consequently, there is a real risk that shoddy construction methods may be used by insufficiently skilled workers or for other reasons, resulting in poorly reinforced wall constructions.

BRIEF SUMMARY OF THE INVENTION

It is accordingly an object of the present invention to provide an improved method of reinforcing a frame wall in a building structure which employs pre-manufactured reinforcement which can be carefully manufactured to accurate tolerances under factory conditions, under controlled environmental conditions, and under careful supervision, before being brought to a construction site for installation in a frame wall.

According to the present invention, a method of reinforcing a building structure including a frame wall against horizontal loads comprises providing a pre-manufactured reinforcement structure which has mutually spaced elongate solid members and a plurality of elongate brace members extending between the side members and angled relative to the side members so as to form, with the side members, a plurality of adjacent triangular structures along the entire length of the side members. The reinforcement structure is installed in the frame wall with the side members vertical.

Since the reinforcement structure comprises triangular structures, it is more resistant to applied forces, e.g. horizontal forces, than conventional stud wall construction. Furthermore, since the reinforcement structure is premanufactured, the reliability of the reinforcement structure does not depend on the level of skills or the environmental conditions at a construction site.

Alternatively, the reinforcement structure may comprise a sheet material extending between and interconnecting members of a frame.

The present method of reinforcing a building structure also, preferably, includes providing pre-manufactured joist support structures, comprising rectangular frames and diagonal brace members, which are installed between and in abutment with joists in the building structure, the joists for structures being located in vertical alignment with the frame walls so as to transmit downwardly acting forces to and from the frame wall instead of relying on rim joists or the like for this purpose.

The present invention also provides substantial increased torsional stiffness to the frame wall.

BRIEF DESCRIPTION OF THE DRAWINGS

The invention will be more readily understood from the following description of embodiments thereof given, by way of example, with reference to the accompanying drawings, in which.

DESCRIPTION OF THE PREFERRED EMBODIMENT

Figure 1:
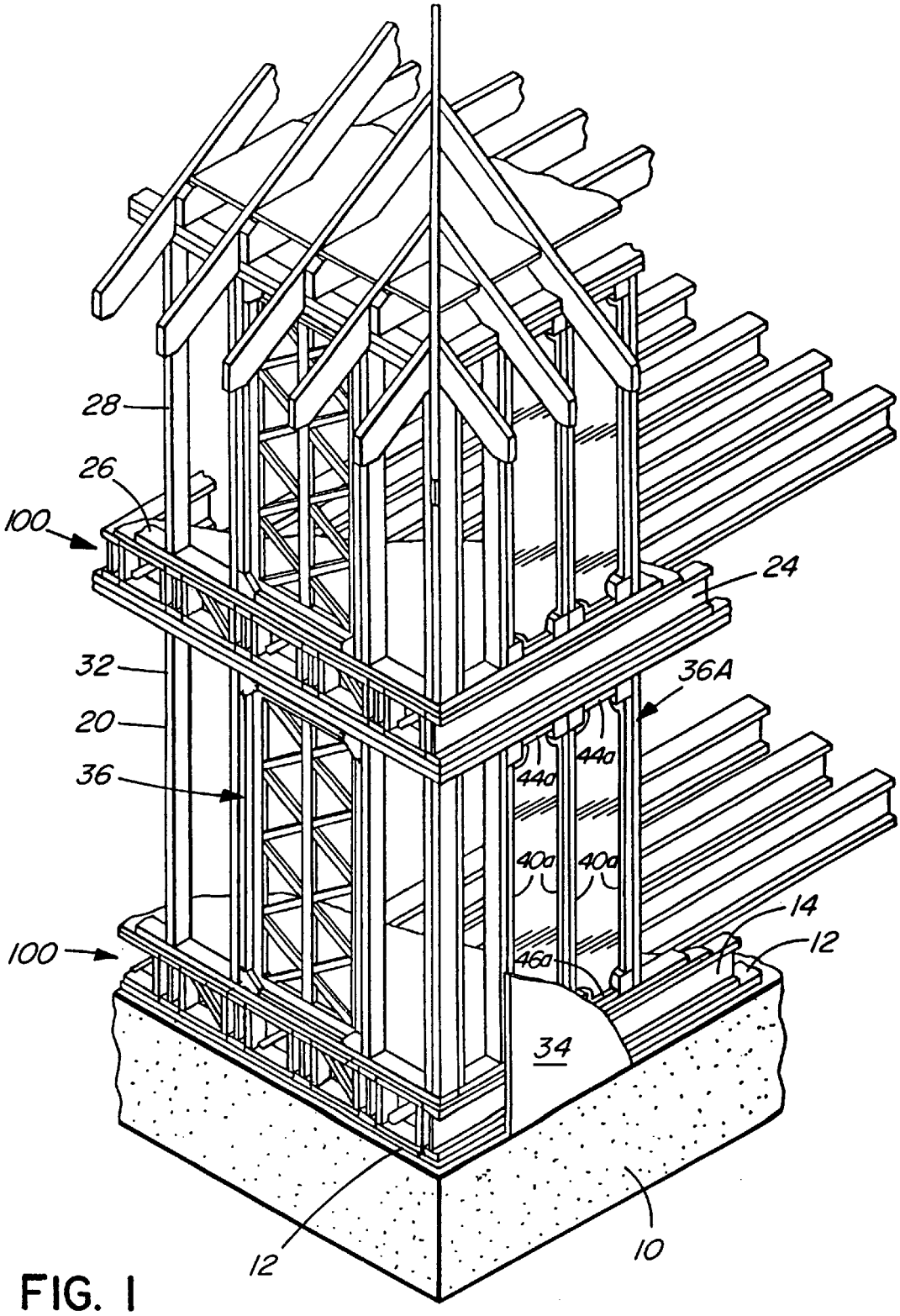
FIG. 1 shows a broken-away view, in perspective, of parts of a frame of a building structure which incorporates reinforcement structures according to the present invention.
Figure 1A:
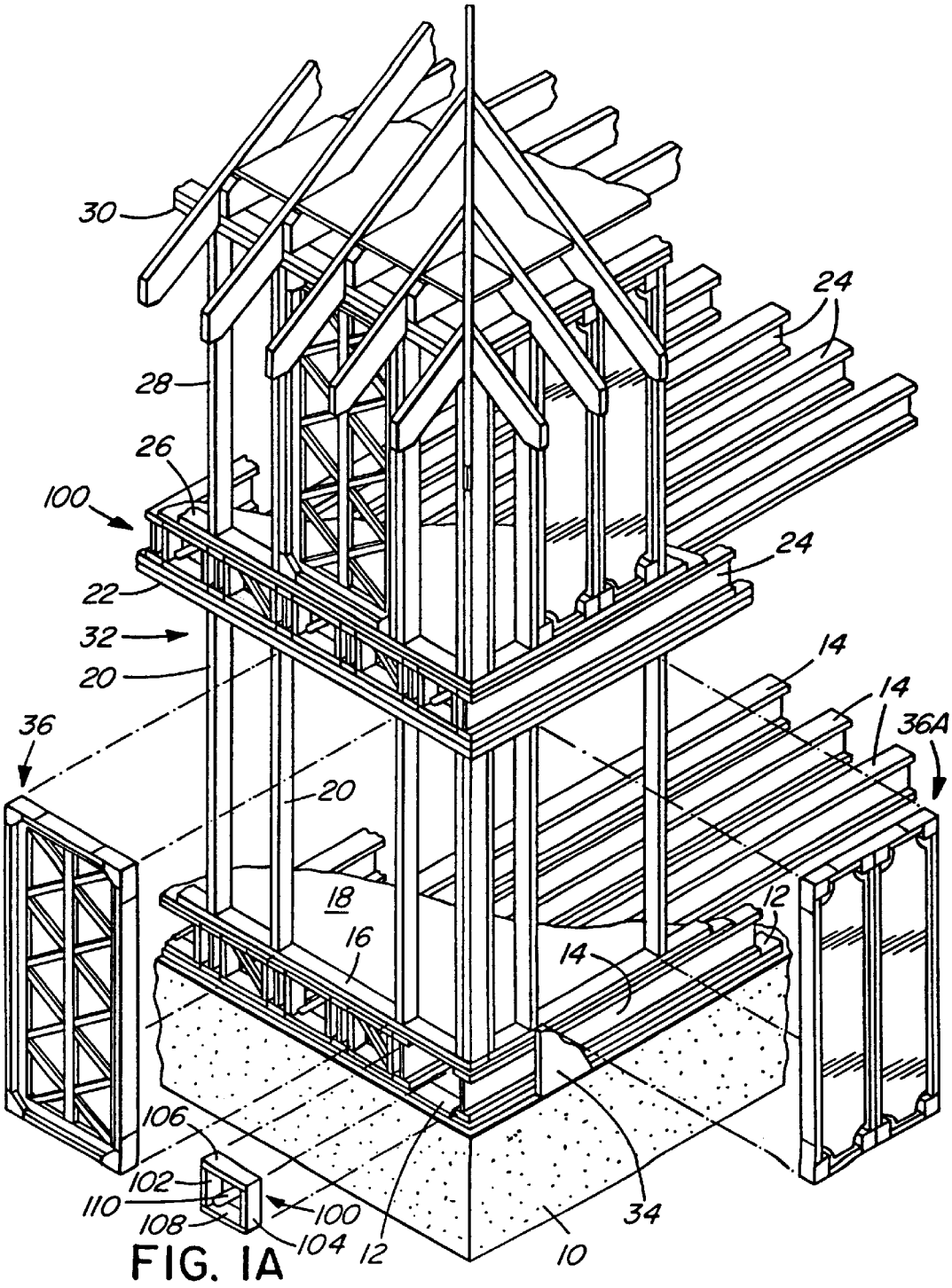
FIG. 1A shows a view corresponding to that of FIG. 1, but with two of the reinforcement structures shown spaced from the remainder of the building structure.
Figure 2:
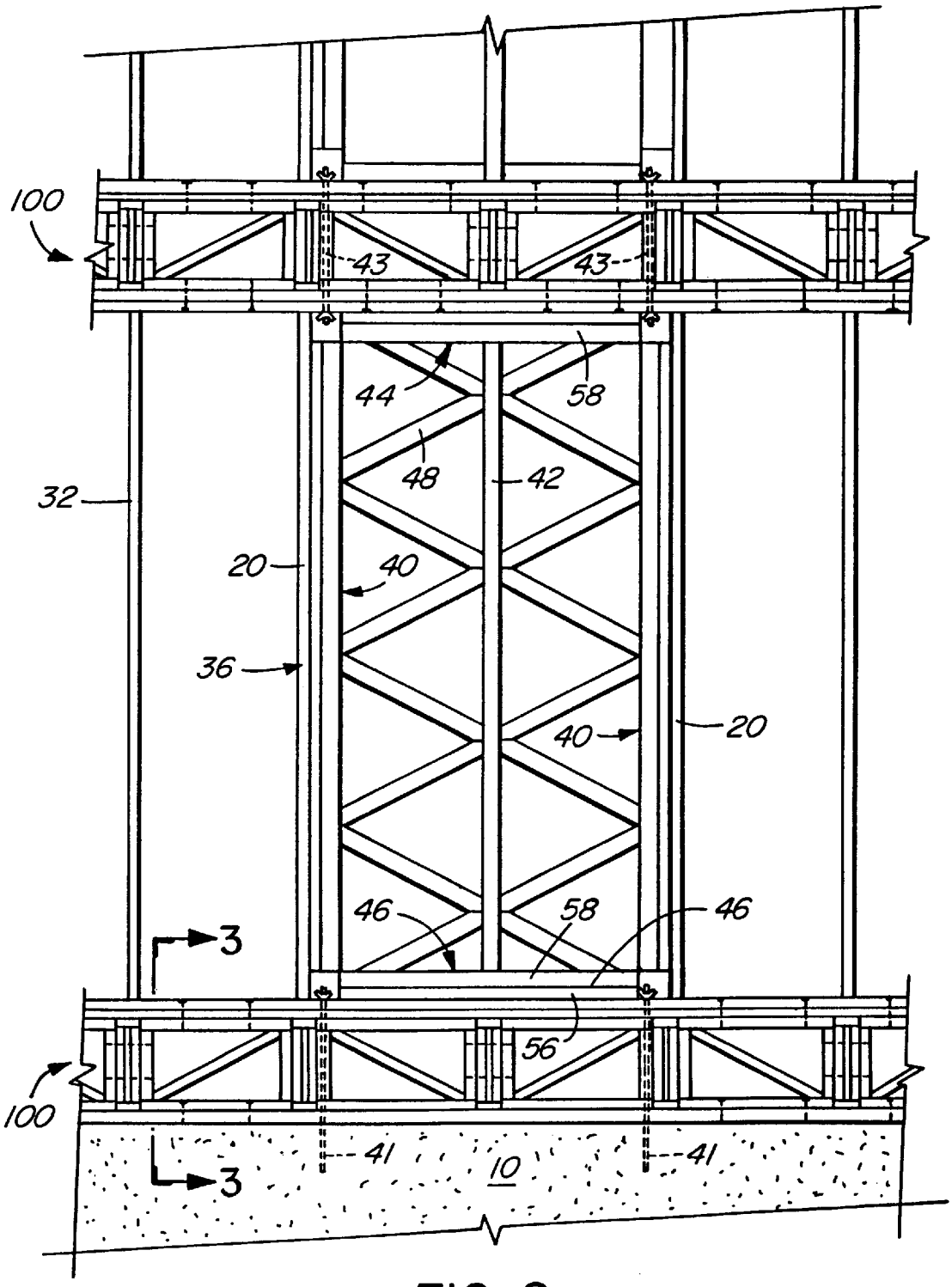
FIG. 2 shows a view in front elevation of parts of the building structure of FIGS. 1 and 2.

In FIGS. 1, 1A and 2 of the accompanying drawings, there is illustrated a broken-away building structure which has a concrete foundation 10 supporting sills 12 which, in turn, support ground floor joists 14. A sole plate 16, carried on flooring 18 on the joists 14, supports studs 20 extending to a top plate 22. Likewise, second storey joists 24 and a sole plate 26 support studs 28, which extend to a top plate 30.

As will be apparent to those skilled in the art, the building structure, as thus far described, is conventional, and the studs 20 with their associated sole plate 16 and top plate 22 form parts of a frame wall indicated generally by reference numeral 32. FIGS. 1 and 1A also illustrate a broken-away sheathing portion 34, which represents part of a sheathing applied, in conventional manner, to the exterior of the frame wall 32. Similar sheathing (not shown) is provided to the exterior of the building above the frame wall 32.

According to the present invention, the frame wall 32 is reinforced against horizontal loads, and also vertical loads, by means of a reinforcement structure which is indicated generally by reference numerals 36 and 36A, each installed between a pair of the studs 20. Although two different reinforcement structures 36 and 36A are shown, for convenience of illustration, in respective walls of the same building structure, it is to be understood that one or more of either of the reinforcement structures could be employed in each wall of a building.

The reinforcement structure 36, as shown in greater detail in FIG. 2, comprises elongate vertical side members 40, which are spaced apart from one another and which abut adjacent ones of the studs 20, and an elongate vertical intermediate member 42, which is provided midway between the side members 40.

An elongate, horizontal top member 44 and an elongate horizontal bottom member 46 extend between the side members 40 and are connected, as described in greater detail below, to the side members 40 and to the top and bottom members 44 and 46 to form a rectangular frame.

The reinforcement structure 36 also includes elongate brace members 48, which are inclined relative to the side and intermediate members 40 and 42 and which extend between and are connected to the side and intermediate members 40 and 42 in abutment with the side and intermediate members so as to form, with the side and intermediate members 40 and 42, the top and bottom members 44 and 46, and one another a plurality of adjacent triangular structures which extend the entire lengths of the each of the side members 40 and opposites sides of the intermediate member 42 and which, thus, are co-extensive with the rectangular frame formed by the side members 40 and the top and bottom members 44 and 46.

The reinforcement structure 36 is secured to the building structure by anchor bolts 41 embedded in the foundation 10, by tie-rods 43 connected to the overlying structure and by nails, bolts, glue or other fastening means to the studs 20.

Figure 5:
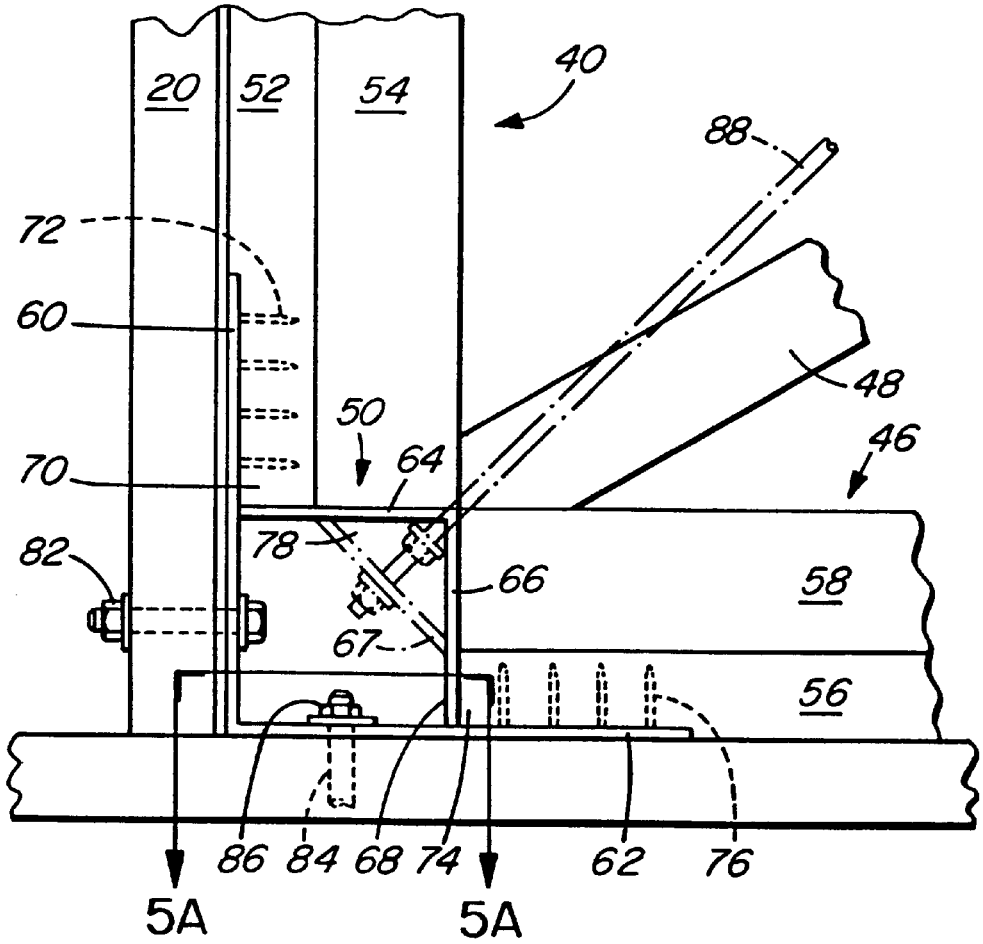
FIG. 5 shows a broken-away view, in front elevation, of a comer of a reinforcement structure shown in FIGS. 1 to 4.

The four comers of this rectangular frame are provided with comer connectors, one of which is indicated generally by reference numeral 50 in FIG. 5, which shows broken-away components of a modification of the reinforcement structure 36 of FIGS. 1 and 2.

Figure 4:
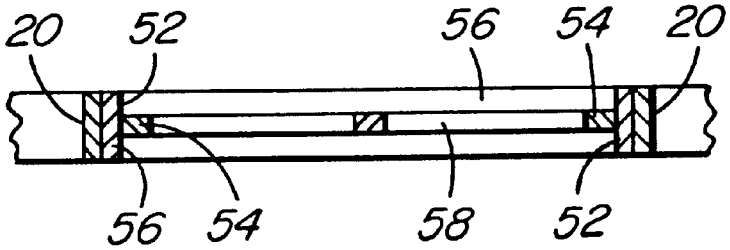
FIG. 4 shows a view taken in transverse cross-section through a reinforcement structure shown in FIGS. 1, 1A and 2.

As illustrated, in particular, in FIGS. 2 and 5, the side member 40 is formed by a board 52, the width of which extends transversely of the reinforcement structure, as shown in FIG. 4, and a wood strip 54, which is secured with one edge thereof in surface-to-surface abutment with a side surface 56 of the board 52, so that the side member 40 has a T-shaped cross-section.

Likewise, the other side member 40 is formed of a board 52 and a wood strip 54 with a T-shaped cross-section and, similarly, the top and bottom members 44 and 46 are each formed of a horizontal board 56, the width of which extends transversely of the reinforcement frame 36, and a wood strip 58 having one edge in abutment with the board 56.

Referring again to FIG. 5, the comer connector 50 comprises a pair of metal plates 60 and 62, which extend at right angles to one another, and a metal intermediate portion extending between the plates 60 and 62, this intermediate portion comprising a flat horizontal plate 64 and a vertical plate 66.

A lower end 70 of the board 52 rests on the plate 64 and is secured by nails 72 to the vertical plate 60, and an end 74 of the bottom portion 46 is in abutment with the vertical plate 66, the horizontal plate 62 being secured to the end 74 by means of nails 76.

Instead of the nails 72 and 76, other means (not shown), e.g. screws, bolts or shear plates, may be used to secure the connector plates 50 to the frame.

Figure 5A:
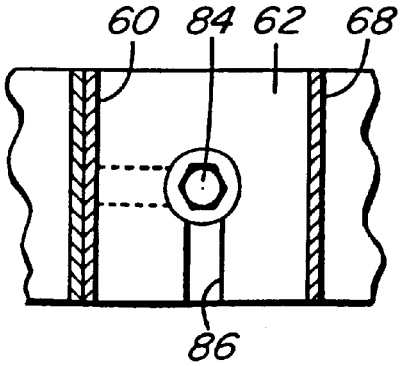
FIG. 5A shows a broken-away view taken in cross-section along the line 5A—5A of FIG. 5.

The comer connector 50 is securely fastened to the adjacent stud 20 by means of a nut-and-bolt fastener 82, and the comer connector 50 is also anchored to the foundation 10 by means of an anchor tie-rod 84 and an associated nut 86. As shown in FIG. 5A, the tie-rod 84 extends through an opening in the form of a cut-out 86 in the horizontal plate 62, the cut-out 86 being open to one side of the plate 62 so as to allow the reinforcement structure 36 to be displaced horizontally into position during installation. Alternatively, the cut-out 86 may be replaced by a cut-out 86A shown in broken lines and extending to the vertical plate 60.

The corner connectors 50 are preferably dimensional and installed so as to provide a controlled, progressive yield at predetermined loading in order to provide sufficient ductility for the reinforcement structure in which they are provided. Connectors such as the comer connectors 50 may also be adapted for connecting other building components, e.g. in roofs or for connecting floors to walls. There is also provided a diagonal reinforcement rod 88 which is secured, at one end thereof, by means of a nut 90 to the comer connector 50. The rod 88 and nut 90 may be omitted.

In a modification of the comer connector 50, the intermediate portion includes an inclined plate, shown in chain-dot lines in FIG. 5 and indicated by reference numeral 67, which extends between the plates 64 and 66.

The comer connector 50 may be omitted in structure in which less strength is acceptable.

Referring again to FIGS. 1 and 1A, it will be seen that the building structure also includes a plurality of joist reinforcement structures, one of which is indicated generally by reference numeral 100 in FIG. 1A, and which are located between and in abutment with the joists 14 and the joists 24. The joist reinforcement structures 100 reinforce the wall against horizontal and vertical loads and provide continuity of the building structure through the wall-to-floor interfaces.

Each joist reinforcement structure 100 comprises a rectangular frame formed by side members 102 and 104, a top member 106 and a bottom member 108, the rectangular frame being provided with a diagonal brace 110.

Figure 3:
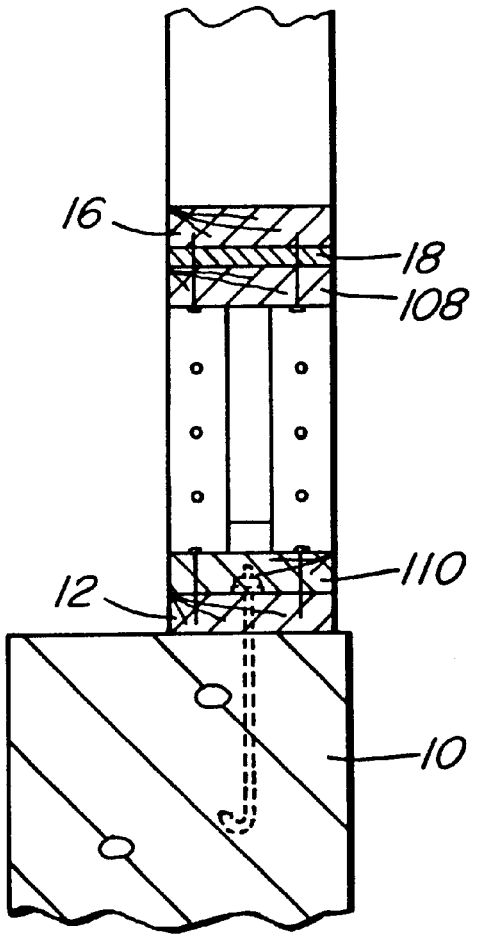
FIG. 3 shows a broken-away view taken in cross-section along the line 3—3 of FIG. 2.

As shown in FIG. 3, the joist reinforcement structure 100 is installed so that the bottom member 110 rests on the sill 12, while the top member 108 supports the flooring 18 and the sole plate 16. The joist reinforcement structure 100 has a vertical height such that it is equal to or greater than that of the joist 14, so that the joist reinforcement structure transmits loads acting vertically downwardly from the overlying frame wall 32 to the foundation. Likewise, the joist reinforcement structures between the ground on the second storey of the building also serve to transmit vertical forces from the overlying structure to the frame wall 32.

Figure 6:
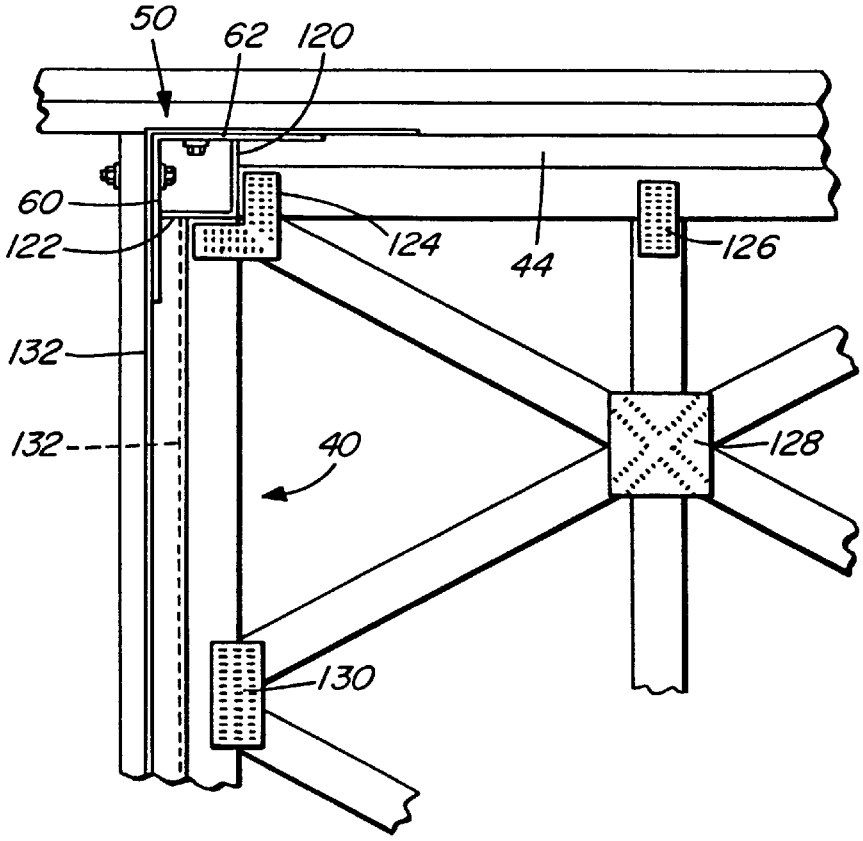
FIG. 6 shows a broken-away view, in front elevation, of parts of a modification of a reinforcement structure shown in FIGS. 1 to 5.

FIG. 6 shows the use of connectors 124, 126, 128, and 130, overlapping the frame members. Connectors 124, 126, 128, and 130 may be conventional metal connector plates, having portions struck out to form prongs which engage in the frame members, in conventional manner. Alternatively, the connectors 124, 126, 128, and 130 may be in the form of patches of reinforced plastic sheet material, which is secured by adhesive to the frame members.

Also, FIG. 6 shows a reinforced plastic strip 132, which is laminated onto the side member 40 and wraps around the corner connector 50A so as to extend partly along the top member 44. Alternatively, a reinforced plastic strip 132*a* may be laminated between the board 52 and the wood strip 54.

Figure 7:
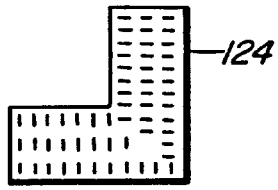
FIG. 7 shows a view in front elevation of a connector plate shown in FIG. 6.

FIG. 7 shows in greater detail the connector 124 which, as can be seen from FIG. 7, is L-shaped.

Figure 8:
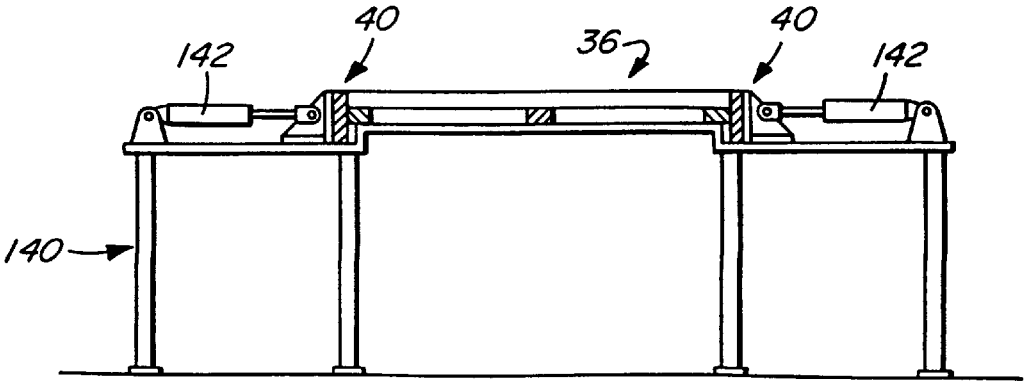
FIG. 8 shows a diagrammatic view, taken in vertical cross-section, through one of the reinforcement structures of FIGS. 1 to 5 during the manufacture thereof.

FIG. 8 shows an apparatus employed for pre-stressing and assembling the reinforcement structure 36 of FIGS. 1, 1A and 2.

As shown in FIG. 8, the components of the rectangular frame of the reinforcement structure of FIGS. 1, 1A and 2 are placed on a support table indicated generally by reference numeral 140, and hydraulic or pneumatic piston and cylinder devices 142, mounted on the table 140, are employed to urge the side members 40 and 42 towards one another. In this way, the components of the reinforcement structure can be pre-loaded, whereupon the corner connectors 50 are secured by the nails 72 and 76 or other means. This pre-loading of the components of the reinforcement structure is employed in order to counter-act the initial "give" which would otherwise occur, if the frame components were simply nailed together in a conventional manner, on the initiation of rocking forces, e. g. as a result of earth quakes or hurricanes, exerted on the reinforcement structure.

The reinforcement structure 36A of FIGS. 1 and 1A has a rectangular frame formed by vertical elongate side members 40A, a horizontal elongate top member 44A and a horizontal elongate bottom member 46A, which are interconnected by comer connectors 50A similar to the comer connectors 50 and by a diaphragm of sheet material 47A, e.g. of plywood, slotted into and glued to the frame. The reinforcement structure 36A is installed between a pair of the studs 20 with the side members 40A abutting the studs 20 and secured to the studs 20 and to the top plate 22 and the sole plate 16 by nails, bolts, glue or other fastening means.

Curved cut-outs 49A are provided at the corners of the sheet material 46A to accommodate the comer connectors 50A and to avoid a concentration of stress in the sheet material at the corners of the reinforcement structure 36A.

Figure 9:
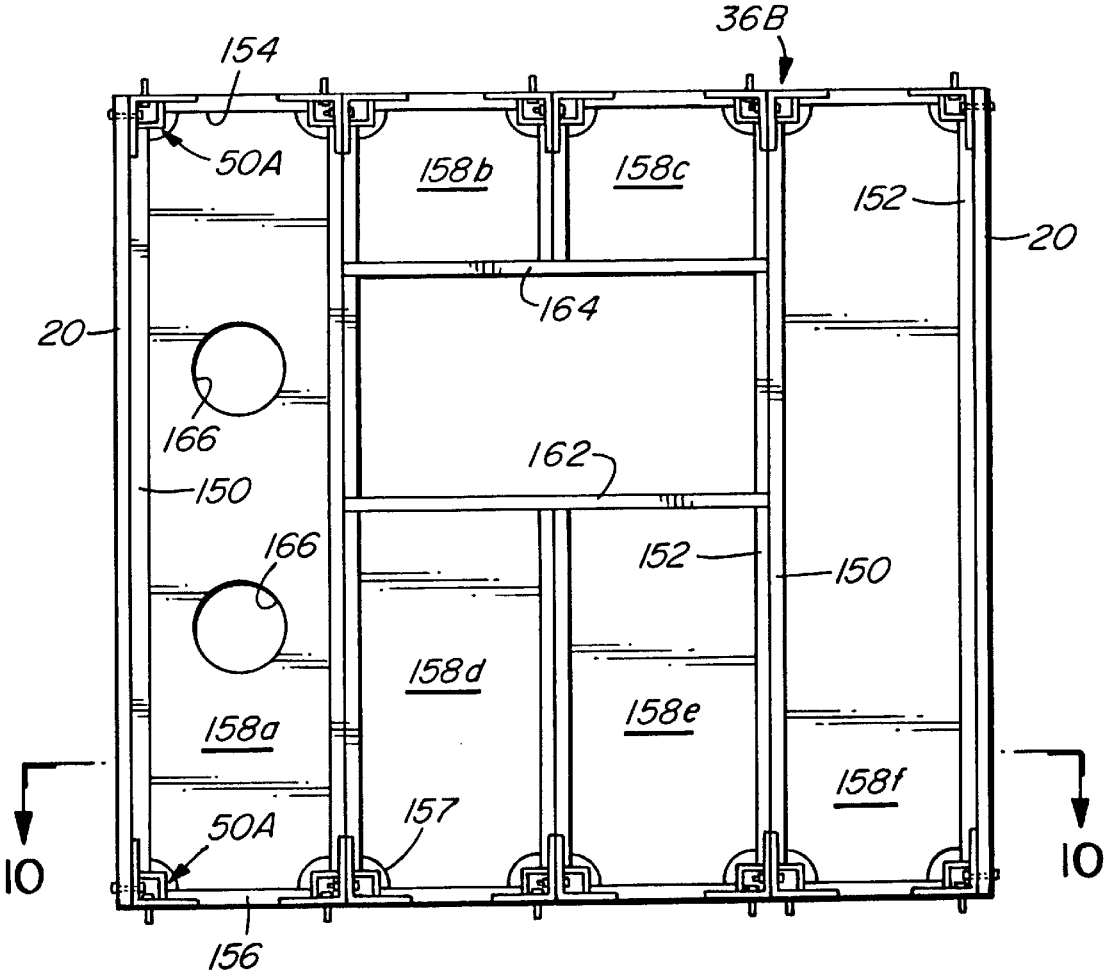
FIG. 9 shows a view in front elevation of part of a frame wall employing a further modified reinforcement structure.
Figure 10:
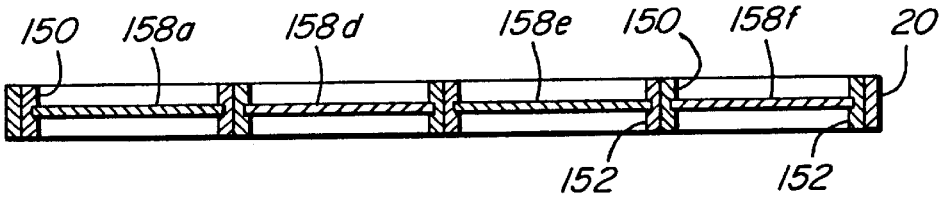
FIG. 10 shows a view taken in cross-section along the line 10—10 of FIG. 9.

FIGS. 9 and 10 show a modified reinforcement structure indicated generally by reference numeral 36B installed between two studs 20. More particularly, the modified reinforcement structure 36B comprises four rectangular frames, having side members 150 and 152 and top and bottom members 154 and 156, with sheet material diaphragms or panels 158A–F secured to the side members 150 and 152 and the top and bottom members 154 and 156. A window opening 160 interrupts the two central rectangular frames, and has a sill 162 and an upper board 164.

The panels 158A–F are each recessed as shown in FIG. 10 into the adjacent members of the rectangular frames, to which they are secured by adhesive, and the reinforcement structure is provided with the comer connectors 50A.

The panel 158A is interrupted by openings 166, which may be employed for plumbing, electrical wiring or other purposes.

While the panels of FIGS. 9 and 10 are recessed into their frame members, it is alternatively possible to employ sheathing panels connected to one another and to the frame members by means of metal connectors, as illustrated in FIGS. 12 through 16, which can be designed to provide controlled stiffness or resistance to racking of the frame.

Figure 11:
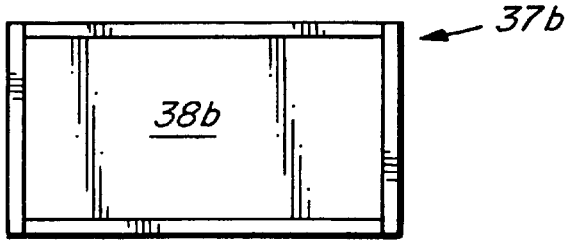
FIG. 11 shows in front elevation a view of another reinforcement structure according to the invention.

FIG. 11 shows a simplified embodiment, indicated generally by reference numeral 36*b*, of the reinforcement structure 36A.

The reinforcement structure 36*b* of FIG. 11 has a rectangular wooden frame, indicated generally by reference numeral 37*b*, and a diaphragm in the form of a plywood panel 38*b* having its edges slotted into and glued to the frame 37*b*. In this embodiment, no metal comer connectors are employed.

Figure 12:
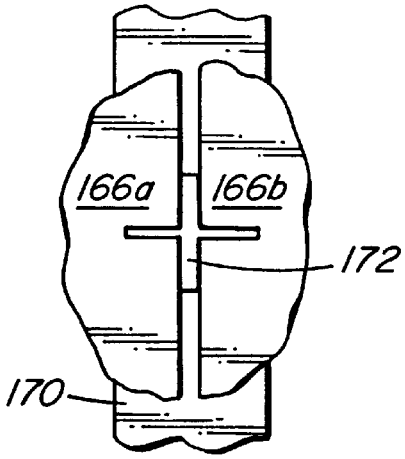
FIGS. 12 through 16 show broken-away views of five different connections between sheathing panels.

FIG. 12 shows broken-away portions of two sheathing panels 168*a* and 168*b*, which are secured to a vertical elongate wood member 170 by means of a cross-shaped metal fastener 172, which is pressed into embedded engagement with the elongate wood member 170 and the panels 168*a* and 168*b*.

Figure 13:
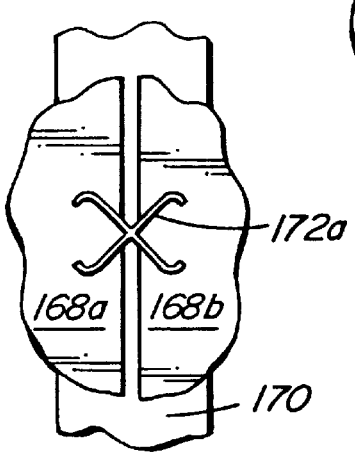
Figure 14:
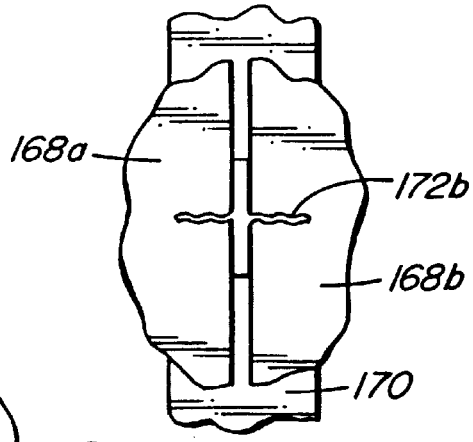

In FIGS. 13 and 14, there are shown modified cruciform connectors, indicated by reference numerals 172*a* and 172*b*, respectively, which are embedded in the plywood panels 168*a* and 168*b* and in the elongate wood member 170 for the same purpose.

Figure 15:
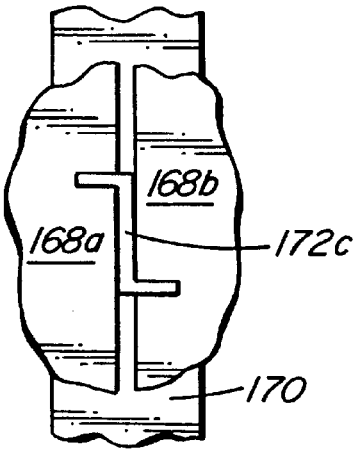
Figure 16:
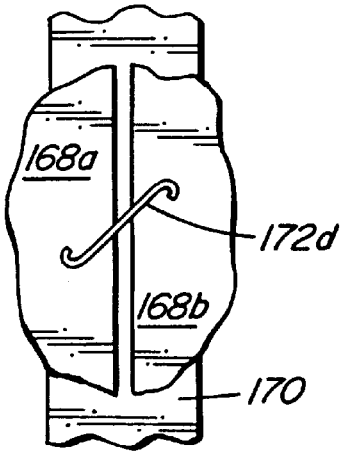

FIGS. 15 and 16 illustrate the use of generally S-shaped fasteners 172*c* and 172*d* for the same purpose. These fasteners 172*a–d* may also be used to interconnect elongate members.

Figure 17:
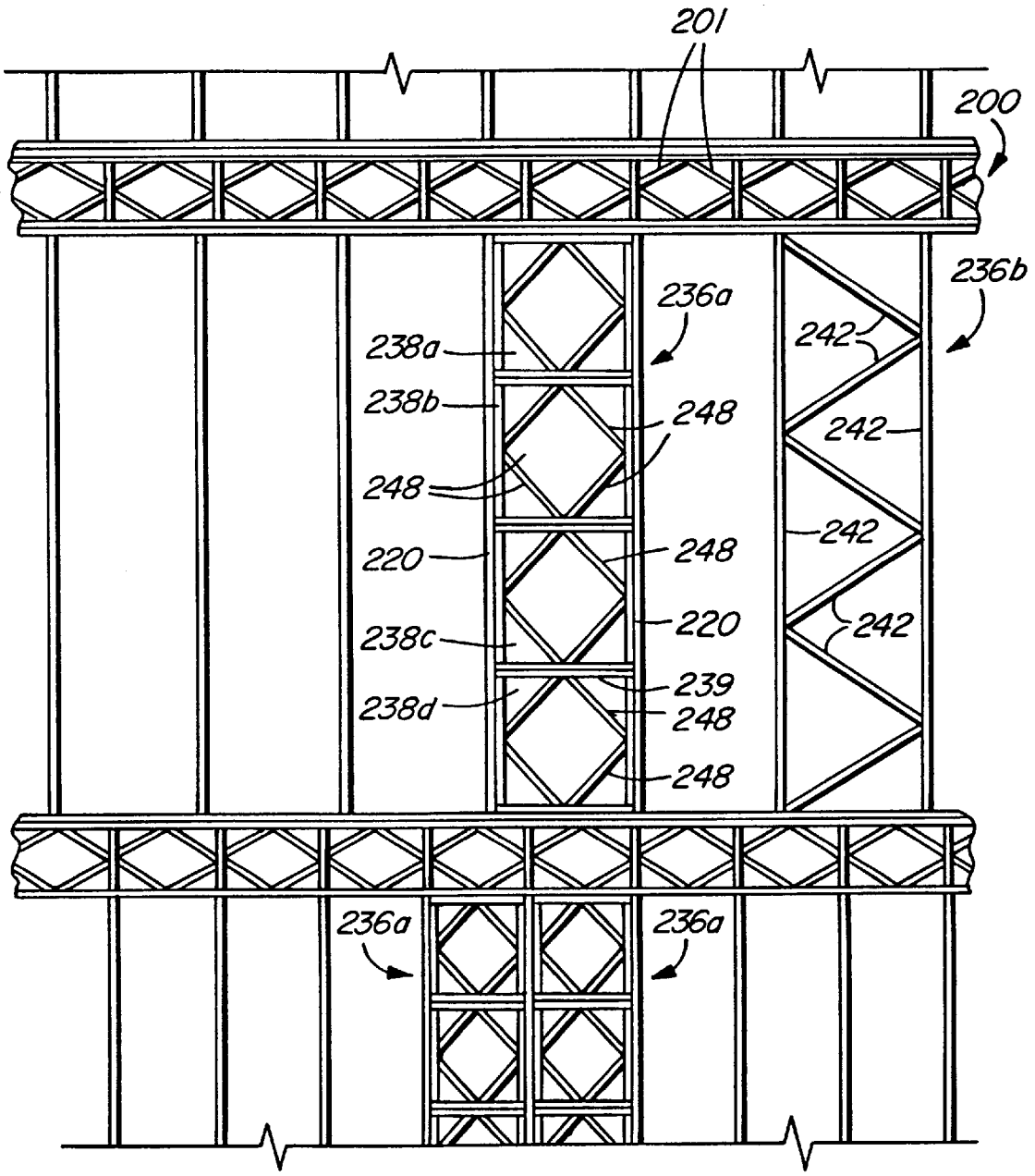
FIG. 17 shows a broken-away view of a frame wall incorporating two further reinforcement structures according to the invention.

FIG. 17 diagrammatically illustrates two modified reinforcement structures 236*a* and 236*b* in a frame wall. The reinforcement structure 236*a* comprises four rectangular frames 238 *a–d*, which are located between a pair of wall studs 220, to which they are secured by nails, bolts or other suitable fastening means (not shown). The frames 238 *a–d* include inclined brace members 248 which, as shown, form with the frames a plurality of triangular structures extending along the lengths of the opposite sides of the frames 238 *a–d*.

A pair of the reinforcement structures 236*a* may be juxtaposed, as shown at the bottom of FIG. 17.

The reinforcement structure 236*b* has opposite side members 242 and inclined brace members 243 which each extend from one to the other of the side members 242 and form therewith adjacent triangular structures extending the lengths of the side members 242.

FIG. 17 also diagrammatically illustrates joist reinforcement structures indicated generally by reference numeral 200, which each comprise a rectangular frame with inclined braces 201 in diamond-shaped arrays within the rectangular frames and forming, with the rectangular frames, triangular structures.

The above-described reinforcement structure may be strengthened by the incorporation in the structures of reinforced plastic materials as disclosed, e.g. in U.S. Pat. No. 5,362,545, issued Nov. 8, 1994; U.S. Pat. No. 5,498,460, issued May 12, 1996; U.S. Pat. No. 5,565,257, issued Oct. 15, 1996; U.S. Pat. No. 5,641,553, issued Jun. 24, 1997, and U.S. Pat. No. 5,648,138, issued Jul. 15, 1997, all issued to Daniel A. Tingley, or by the use of densified wood as disclosed, e.g. in U.S. Pat. No. 5,188,707, issued Feb. 23, 1993, the disclosures of which are incorporated herein by reference.

As will be apparent to those skilled in the art, modifications may be made in the above-described invention within the scope of the apppended claims.

We claim:

1. A frame wall reinforcement structure, comprising:

a rectangular frame;

said frame comprising elongate wooden side, top and bottom frame members;

metal comer connectors connecting said side frame members to said top and bottom frame members;

brace members extending between said side members;

said corner connectors each comprising vertical and horizontal metal plates and an intermediate portion between said vertical and horizontal metal plates;

fasteners securing said frame members in face-to-face contact with said metal plates;

said fasteners including anchor members; and said horizontal metal plates connected to said bottom frame member having cutouts slidably receiving said anchor members so as to allow said frame to be displaced horizontally into position.

2. A frame wall reinforcement structure as claimed in claim 1, wherein said anchor members comprise anchor tie rods extending through said horizontal metal plates and anchoring said frame to a support beneath said frame.

3. A frame wall reinforcement structure as claimed in claim 1, including a reinforcement rod, said rod extending diagonally of said frame and having ends thereof secured to a pair of said corner connectors.

4. A frame wall reinforcement structure as claimed in claim 1, wherein said brace members are angled relative to said side members and abut one another and said side members so as to form a plurality of adjacent triangular structures.

5. A frame wall reinforcement structure as claimed in claim 1, wherein said intermediate portions of said corner connectors each comprise a horizontal plate and a vertical plate and said frame members have ends in abutment with said horizontal and vertical plates of said intermediate portions.

* * * * *